US005752633A

United States Patent [19]

Antaki

[11] Patent Number: 5,752,633

[45] Date of Patent: May 19, 1998

[54] FLASHLIGHT HOLSTER

[76] Inventor: Michael F. Antaki, 109 Hobart Ave., Port Chester, N.Y. 10573

[21] Appl. No.: 583,448

[22] Filed: Jan. 5, 1996

[51] Int. Cl.[6] ..... A42B 1/24

[52] U.S. Cl. ..... 224/222; 224/223; 224/683; 224/901.4

[58] Field of Search ..... 224/222, 221, 224/223, 181, 930, 901, 901.2, 901.4, 683

[56] References Cited

U.S. PATENT DOCUMENTS

| | | | |
|---|---|---|---|
| 1,200,403 | 10/1916 | Weyer | 224/221 X |
| 2,317,820 | 4/1943 | Smith | 224/683 X |
| 3,005,091 | 10/1961 | Cote | 224/930 |
| 4,432,477 | 2/1984 | Haidt et al. | 224/222 |
| 4,508,249 | 4/1985 | Kotchy | 224/222 X |
| 4,718,126 | 1/1988 | Slay | 224/901.4 |
| 4,729,499 | 3/1988 | Martin | 224/181 |
| 4,831,997 | 5/1989 | Greene | 24/306 X |
| 4,939,818 | 7/1990 | Hahn | 24/442 |
| 5,034,862 | 7/1991 | Liston | 362/105 |
| 5,102,024 | 4/1992 | Boersma et al. | 224/901.4 |
| 5,433,359 | 7/1995 | Flowers | 224/222 |

*Primary Examiner*—Renee S. Luebke
*Attorney, Agent, or Firm*—Thomas A. Gallagher

[57] ABSTRACT

A flashlight holster includes a first elastic strap, one end of which is attached to a D-ring, and the other end is provided with a "first" VELCROT™ patch (preferably on both sides). A longitudinal pocket having either one or two open ends is formed from a second rectangular elastic strap which is stitched to the first elastic strap. An orthogonal pocket having two open ends is formed from a third rectangular elastic strap which is stitched to the longitudinal pocket at a center portion thereof. The orthogonal pocket is preferably provided with on outer reflective patch. Two "second" VELCRO™ patches are provided on the longitudinal pocket on opposite sides of the orthogonal pocket. Each of the pockets is dimensioned to accept the barrel of a flashlight when the pocket is stretched so that the flashlight is securely held in the pocket. Thus, the longitudinal pocket holds a flashlight with the barrel of the flashlight parallel to the strap and the orthogonal pocket holds a flashlight with the barrel of the flashlight perpendicular to the strap. The strap is easily attached to a human arm or leg by wrapping the strap around the limb and attaching the first VELCRO™ patch to the second VELCRO™ patch. Several different embodiments are disclosed.

10 Claims, 5 Drawing Sheets

FLASHLIGHT HOLSTER

BACKGROUND OF THE INVENTION

1. Field of the Invention

The invention relates to belts and straps (i.e. holsters) used to attach a flashlight to the human body or to an object. More particularly, the invention relates to a flashlight holster having at least one flashlight pocket and being capable of holding a flashlight in at least two different orientations.

2. State of the Art

The present invention solves several longstanding problems. In particular, the invention solves problems relating to the use of flashlights in general and also solves problems relating to night time safety.

With regard to flashlights in general, it has long been known that hand held flashlights have the chief disadvantage that they must be held by a hand. The holder of the flashlight often requires the use of both hands and is forced to attempt to balance the flashlight in an inconvenient location such as an armpit, a shoulder, mouth, or a nearby fixture. Under these circumstances, it is difficult or impossible to properly aim the flashlight. Several solutions to this common problem are known, including flashlights which are mounted on helmets or headbands, flashlights with clips or magnets to attach to fixtures, and recently flashlights with goose necks. While these solutions are often successful, each is limited in its own way.

With regard to night time safety, it has long been known to provide reflectors and lights which are attachable to the human body for use at night. Reflective strips are often incorporated in articles of clothing such as jogging suits and wind breakers. Recently, strap on strobe lights have been available for attachment to the body. These devices are very popular because they are effective in making the wearer visible to traffic, for example. While these devices are effective in helping the wearer to be seen, they generally do not help the wearer to see. Moreover, being able to see in the dark is equally as important as being able to be seen. For example, a jogger wearing a reflector or a strobe light will be seen by a passing automobile, but the jogger will not necessarily be able to see unilluminated hazards.

The problem of night time safety is particularly acute with respect to children who lack the experience necessary to avoid hazards in the dark. Moreover, children may tend to resist wearing safety apparel due to peer pressure.

SUMMARY OF THE INVENTION

It is therefore an object of the invention to provide a flashlight holster for attaching a flashlight to the human body or to an object.

It is also an object of the invention to provide a flashlight holster which is capable of attaching a flashlight to a human arm, leg, or wrist, as well as to a bicycle or a bicycle helmet.

It is another object of the invention to provide a flashlight holster for holding a flashlight so that the flashlight can be oriented in at least two different directions.

It is still another object of the invention to provide a flashlight holster which is adjustable to fit different sized human limbs and objects.

It is a further object of the invention to provide a flashlight holster for use by children which securely attaches a flashlight to a child's arm, leg, or wrist.

It is also an object of the invention to provide a flashlight holster which children and young adults will find attractive and fun to wear.

It is still another object of the invention to provide a flashlight holster which can be used by electricians, plumbers, mechanics, carpenters, repair personnel and the like to free their hands when working in the dark.

In accord with these objects which will be discussed in detail below, the flashlight holster of the present invention includes a strap having fastening means so that the strap can be wrapped around an object and thereby affixed to the object and at least one pocket for securing a flashlight to the strap. As used herein, the term "pocket" should be construed broadly and can mean two pieces of material which are attached to each other along three lines (a pocket with one open end), attached along two lines (a pocket with two open ends), or attached at several points (a pocket with several open ends). In addition, "pocket" can mean a single piece of material which is folded and attached along two lines. Furthermore, a "pocket" can mean a single piece of material provided with one or more slits through which the barrel of a flashlight can be inserted and held securely.

According to a first embodiment of the invention, the flashlight holster includes a first elastic strap approximately two inches wide and approximately fourteen inches long, expandable to approximately twenty-two inches long. One end of the first elastic strap is attached to a D-ring (preferably by stitching), and the other end is provided with a "first" VELCRO™ patch (preferably on both sides). As used herein, "first" patch and "second" patch form a mating pair. A longitudinal pocket having either one or two open ends is formed from a second rectangular elastic strap which is stitched to the first elastic strap. An orthogonal pocket having two open ends is formed from a third rectangular elastic strap which is stitched to the longitudinal pocket at a center portion thereof. The orthogonal pocket is preferably provided with on outer reflective patch. Two "second" VELCRO™ patches are provided on the longitudinal pocket on opposite sides of the orthogonal pocket. Each of the pockets is dimensioned to accept the barrel of a flashlight when the pocket is stretched so that the flashlight is securely held in the pocket. Thus, the longitudinal pocket holds a flashlight with the barrel of the flashlight parallel to the strap and the orthogonal pocket holds a flashlight with the barrel of the flashlight perpendicular to the strap. The strap is easily attached to a human arm or leg by wrapping the strap around the limb and attaching the first VELCRO™ patch to the second VELCRO™ patch. When attached to an ankle or upper arm, for example, a flashlight inserted in the longitudinal pocket will be aligned substantially perpendicular to the wearer's leg or upper arm and will project light either forward or backward from the wearer. When attached to a wrist, a flashlight inserted in the orthogonal pocket will be aligned with the axis of the wearer's forearm and will project light in the direction of the wearer's arm. The strap can also be attached to a bicycle helmet or almost any object of suitable size. The strap is adjustable to different sizes due to its elasticity, the placement of the VELCRO™ patches, and the D-ring. The provision of the D-ring allows the strap to fit snugly around small objects or limbs. When the end of the strap having the first VELCRO™ patches is looped through the D-ring, the strap can be doubled over to tighten it's grip and allow attachment to smaller limbs and objects.

According to a second embodiment of the invention, a longitudinal pocket having two open ends is formed from a second elastic strap which is stitched to the first elastic strap and an orthogonal pocket having two open ends is formed from a third elastic strap which is stitched to the first elastic strap. One or more reflective patches and "second" VELCRO™ patches are provided on any of the first, second, or third elastic straps.

According to a third embodiment of the invention, a combination pocket having four open ends is formed from a rectangular second elastic strap which is stitched to the first elastic strap at four corners. One or more reflective patches and "second" VELCRO™ patches are provided on either of the first or second elastic straps.

According to a fourth embodiment of the invention, a combination pocket having three open ends is formed from a second triangular elastic strap which is stitched to the first elastic strap at three corners. One or more reflective patches and "second" VELCRO™ patches are provided on either of the first or second elastic straps.

According to a fifth embodiment of the invention, multiple orthogonal pockets are provided for holding several flashlights simultaneously.

According to a sixth embodiment of the invention, pockets are formed on an elastic strap by providing holes or slits in the strap at appropriate locations.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
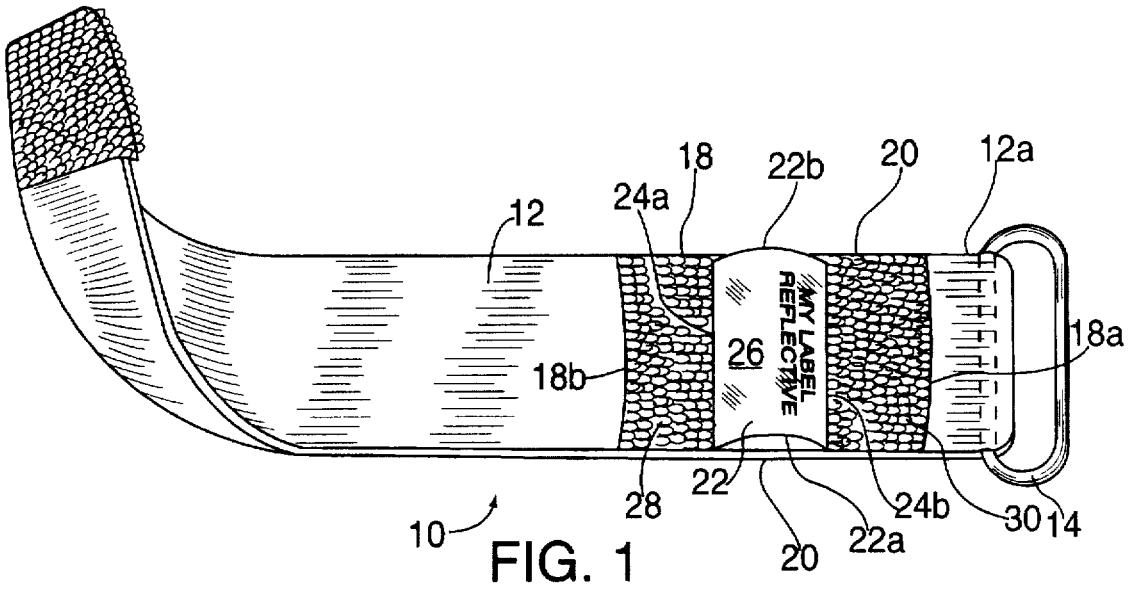
FIG. 1 is a perspective view of a first embodiment of the invention.
Figure 2:
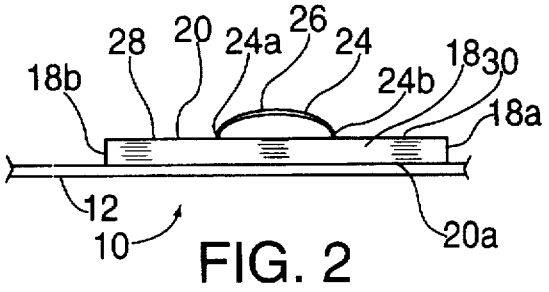
FIG. 2 is a broken side elevational view of the first embodiment of the invention.

Referring now to FIGS. 1 and 2, a first embodiment of the flashlight holster 10 according to the invention includes a first elastic strap 12 which is preferably approximately two inches wide and approximately fourteen–fifteen inches long, expandable to approximately twenty-two inches long. One end 12*a* of the first elastic strap 12 is attached to a D-ring 14 (preferably by stitching), and the other end is provided with a "first" VELCRO™ patch 16. The first VELCRO™ patch 16 is preferably provided on two sides 16*a*, 16*b* or comprises two patches. A longitudinal pocket 18 having either one or two open ends 18*a*, 18*b* is formed from a second rectangular elastic strap 20 which is stitched to the first elastic strap 12 along two edges 20*a*, 20*b*. An orthogonal pocket 22 having two open ends 22*a*, 22*b* is formed from a third rectangular elastic strap 24 which is stitched to the second elastic strap 20 at a center portion thereof and along two edges 24*a*, 24*b* of the third elastic strap 24. The orthogonal pocket 22 is preferably provided with on outer reflective patch 26. Two "second" VELCRO™ patches 28, 30 are provided on the longitudinal pocket 18 on opposite sides of the orthogonal pocket 22. Each of the pockets 18, 22 is dimensioned to accept the barrel of a flashlight as shown and described below with reference to FIGS. 6–11.

Figure 3:
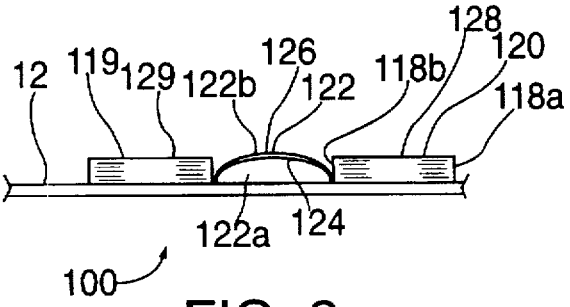
FIG. 3 is a view similar to FIG. 2 of a second embodiment of the invention.

Turning now to FIG. 3, a second embodiment of a holster 100 according to the invention, also includes a first elastic strap 12 and a first VELCRO™ patch (not shown) and a D-ring (not shown). In this embodiment, a first longitudinal pocket 118 having two open ends 118*a*, 118*b* is formed from a second elastic strap 120 which is stitched to the first elastic strap 12 and an orthogonal pocket 122 having two open ends 122*a*, 122*b* is formed from a third elastic strap 124 which is stitched to first elastic strap 12. One or more reflective patches 126 and "second" VELCRO™ patches 128 are provided on any of the first 12, second 120, or third 124 elastic straps. Optionally, a second longitudinal pocket 119 is formed on the other side of the orthogonal pocket 122 and is provided with a second VELCRO™ patch 129.

Figure 4:
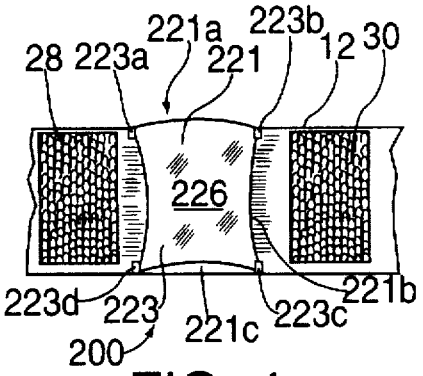
FIG. 4 is a broken plan view of a third embodiment of the invention.

FIG. 4 shows a third embodiment of a holster 200 according to the invention having a first elastic strap 12 with a first VELCRO™ patch (not shown) and a D-ring (not shown). According to this embodiment, a combination pocket 221 having four open ends 221*a*–221*d* is formed from a rectangular second elastic strap 223 which is stitched to the first elastic strap 12 at four corners 223*a*–223*d*. One or more reflective patches 226 and "second" VELCRO™ patches 28, 30 are provided on either of the first 12 or second 223 elastic straps.

Figure 5:
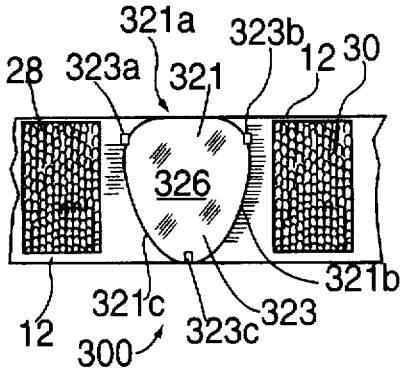
FIG. 5 is a view similar to FIG. 4 of a fourth embodiment of the invention.

FIG. 5 shows a fourth embodiment of a holster 300 according to the invention, having a first elastic strap 12 with a first VELCRO™ patch (not shown) and a D-ring (not shown). According to the fourth embodiment of the invention, a combination pocket 321 having three open ends 321*a*–321*c* is formed from a second triangular elastic strap 323 which is stitched to the first elastic strap 12 at three corners 323*a*–323*c*. One or more reflective patches 326 and "second" VELCRO™ patches 28, 30 are provided on either of the first 12 or second 323 elastic straps.

Figure 8:
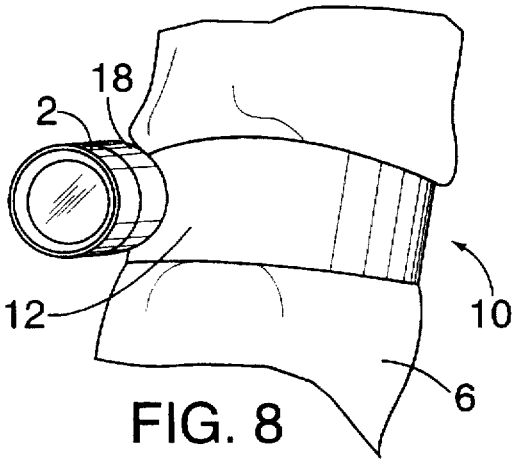
FIGS. 8 and 9 are perspective views of the first embodiment of the invention with a flashlight attached to an upper arm.
Figure 9:
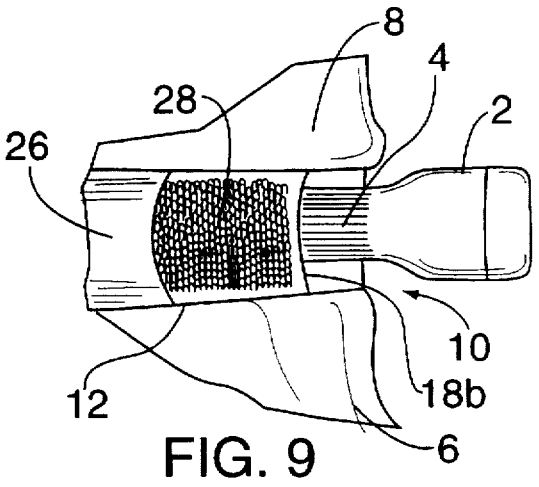
Figure 10:
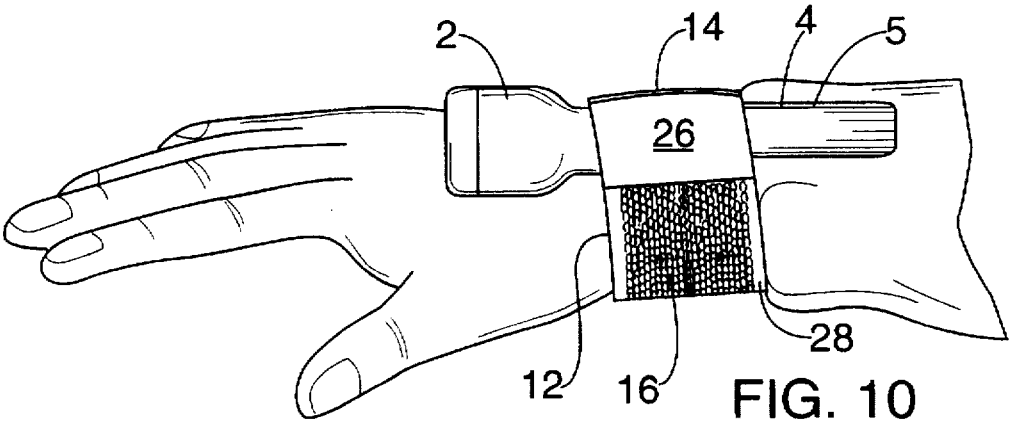
FIG. 10 is a perspective view of the first embodiment of the invention with a flashlight attached to a wrist.
Figure 11:
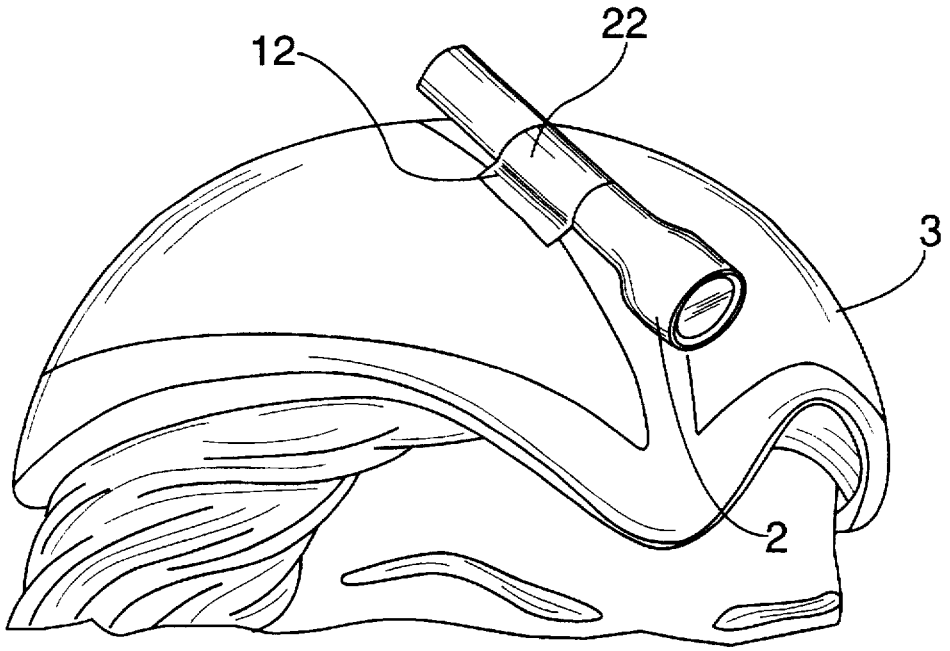
FIG. 11 is a perspective view of the first embodiment of the invention with a flashlight attached to a bicycle helmet.

Referring now to FIGS. 6–11 and with reference to the first embodiment 10 shown in FIGS. 1 and 2, the longitudinal pocket 18 holds a flashlight 2 with the barrel 4 of the flashlight 2 parallel to the strap 12 and the orthogonal pocket 22 holds a flashlight 2 with the barrel 4 of the flashlight perpendicular to the strap 12. The strap is easily attached to a human arm (6 in FIGS. 8 and 9) or leg (7 in FIGS. 6 and 7) by wrapping the strap 12 around the limb and attaching the first VELCRO™ patch 16 to one of the second VELCRO™ patches 28, 30. When attached to an ankle or upper arm, for example as shown in FIGS. 6, 7 and 8, 9, a flashlight 2 inserted in the longitudinal pocket 18 will be aligned substantially perpendicular to the wearer's leg 7 or upper arm 6 and will project light either forward or backward from the wearer. When attached to a wrist 5, as shown in FIG. 10, a flashlight 2 inserted in the orthogonal pocket 22 will be aligned with the axis of the wearer's forearm and will project light in the direction of the wearer's arm. The strap 12 can also be attached to a bicycle helmet 3 as shown in FIG. 11 or almost any object of suitable size.

Figure 6:
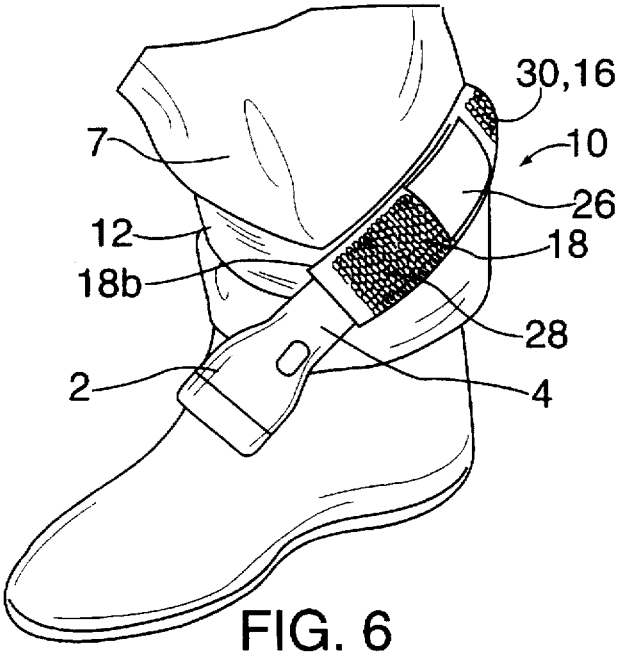
FIGS. 6 and 7 are perspective views of the first embodiment of the invention with a flashlight attached to an ankle.
Figure 7:
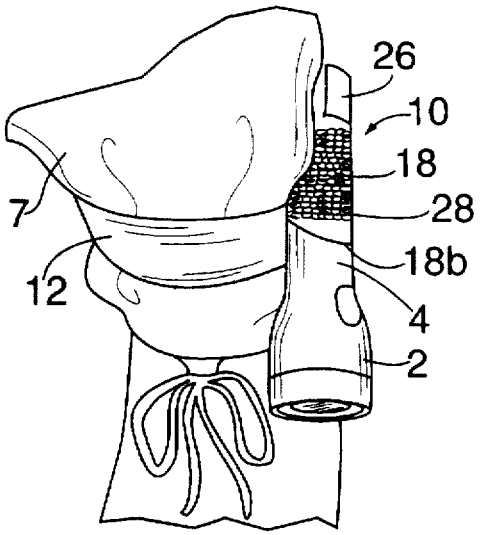
Figure 12:
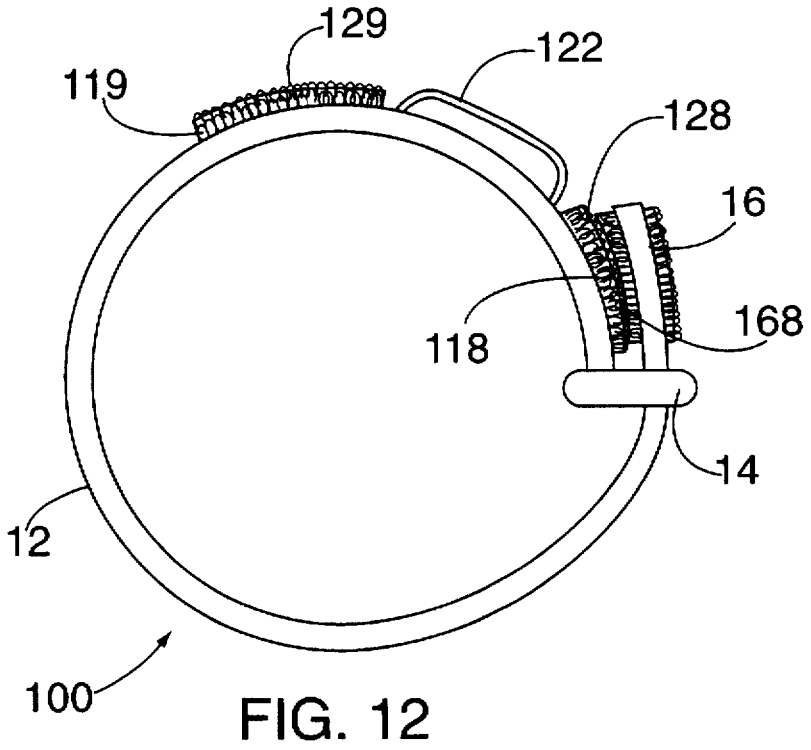
FIG. 12 is a side elevational view of the second embodiment of the invention in a first wrapped position.
Figure 13:
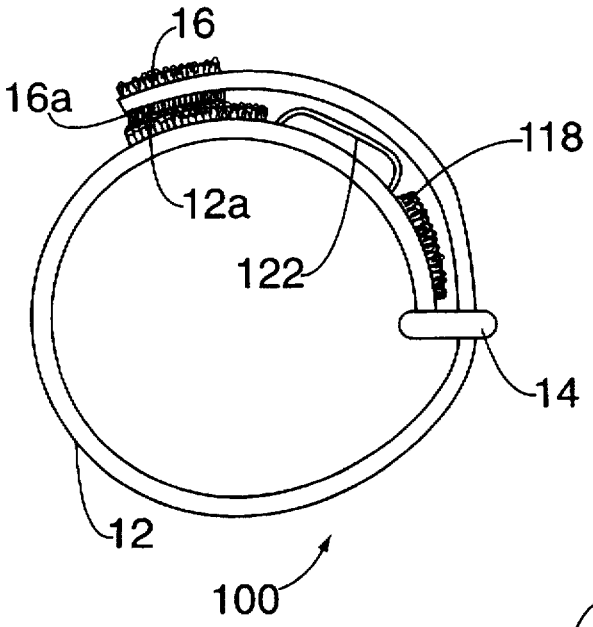
FIG. 13 is a side elevational view of the second embodiment of the invention in a second wrapped position.
Figure 14:
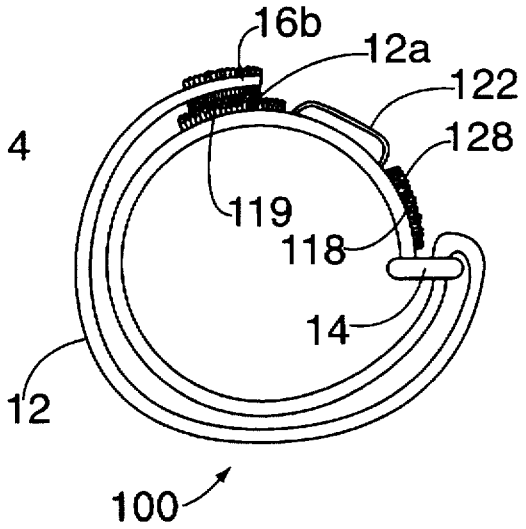
FIG. 14 is a side elevational view of the second embodiment of the invention in a third wrapped position.

Turning now to FIGS. 12–14 and with reference to the second embodiment 100 shown in FIG. 3, the strap 12 is adaptable to different sizes due to its elasticity, the placement of the VELCRO™ patches 16, 128, 129, and the D-ring 14. Thus, when attaching the strap 12 to the upper arm for example as seen in FIGS. 8 and 9, the VELCRO™ patch 16*a* is preferably mated with the VELCRO™ patch 118 which is closest to the D-ring 14. In order to tighten the strap 12 for attachment to an ankle, for example as shown in FIGS. 6 and 7, the VELCRO™ patch 16*a* is preferably mated with the VELCRO™ patch 129 which is more distant from the D-ring 14. Additional VELCRO™ patches at different locations along the strap 12, may be added if desired. The provision of the D-ring 14 allows the strap 12 to fit snugly around small objects or limbs such as around a wrist as shown in FIG. 10 or a bicycle helmet as shown in FIG. 11. When the end of the strap having the first VELCRO™ patches 16*a*, 16*b* is looped through the D-ring 14, the strap can be doubled over as shown in FIG. 14 to tighten it's grip and allow attachment to smaller limbs and objects. The VELCRO™ patch 16*b* may be mated with the VELCRO™ patch 129 which is more distant from the D-ring 14 as shown in FIG. 14. Optionally, the VELCRO™ patch 16*b* may be mated with the VELCRO™ patch 128 to provide an even tighter grip.

Figure 15:
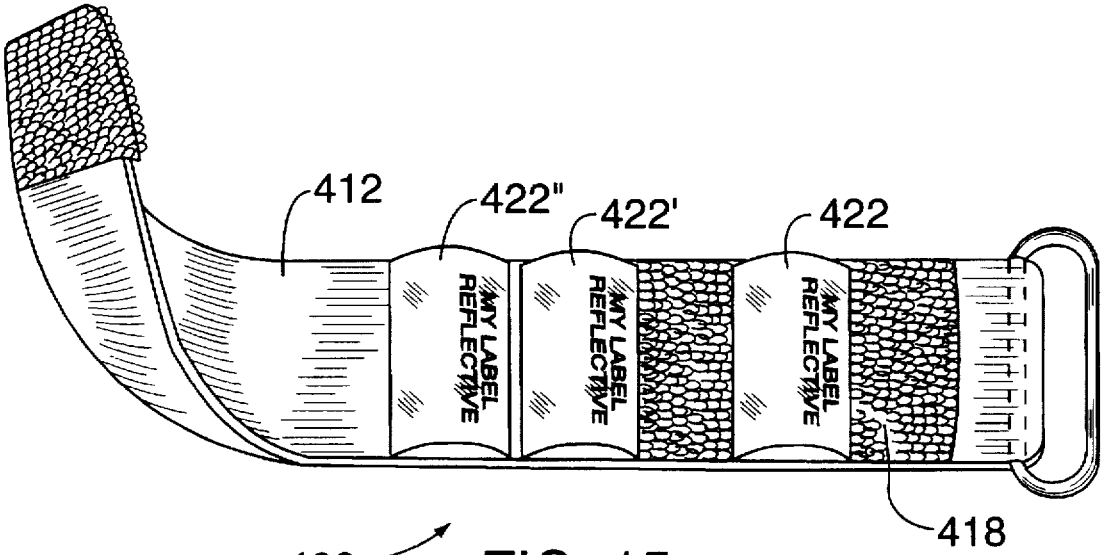
FIG. 15 is a perspective view of a fifth embodiment of the invention.

Turning now to FIG. 15, a fifth embodiment of a holster 400 is substantially the same as the first embodiment described above having a strap 412, a longitudinal pocket 418, and an orthogonal pocket 422. In this embodiment, additional orthogonal pockets 422'and 422" are attached to the strap 412 thereby allowing multiple flashlights to be held simultaneously.

Figure 16:
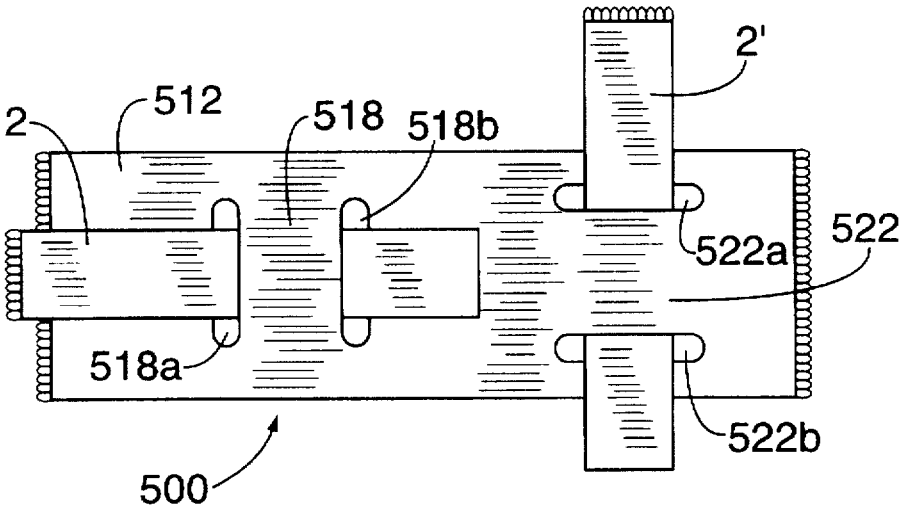
FIG. 16 is a broken plan view of a sixth embodiment of the invention.

As mentioned above, the flashlight holding pockets may be formed in several ways. FIG. 16 shows yet another manner of forming pockets. The holster 500 shown in FIG. 16 has a longitudinal pocket 518 which is formed by providing a pair of parallel spaced apart openings or slits 518*a*, 518*b* in the strap 512. A flashlight 2 is held by sliding the barrel of the flashlight through the slits as shown. The second orthogonal pocket 522 is formed in a similar manner with two slits or openings 522*a*, 522*b* and holds flashlight 2' in substantially the same manner, although in a different orientation.

There have been described and illustrated herein several embodiments of a flashlight holster. While particular embodiments of the invention have been described, it is not intended that the invention be limited thereto, as it is intended that the invention be as broad in scope as the art will allow and that the specification be read likewise. Thus, while particular dimensions have been disclosed, it will be appreciated that other dimensions could be utilized. Also, while elastic straps have been shown, it will be recognized that other types of straps could be used with similar results obtained. Moreover, while particular configurations have been disclosed in reference to VELCRO™ attachments, it will be appreciated that other configurations could be used as well. In lieu of VELCRO™, snaps or other fasteners could be used. Furthermore, while the holster has been disclosed as having a D-ring, it will be understood that many of the primary advantages of the invention can be achieved without the D-ring. In addition, while embodiments of the invention have been shown with one, two, and three pockets, additional pockets could be provided without departing from the spirit of the invention. Furthermore, while the holster has been shown with a single reflective patch, additional reflective patches could be provided and the entire strap could be made reflective if desired. While a reflective patch is considered desirable, the presence or absence of a reflective patch is not critical to the invention. It will therefore be appreciated by those skilled in the art that yet other modifications could be made to the provided invention without deviating from its spirit and scope as so claimed.

I claim:

1. A flashlight holster comprising:

a strap having fastening means for affixing the strap to an object or human limb and pocket means fixedly attached to said strap for receiving and holding a flashlight in at least two mutually orthogonal orientations without removing the strap from the object or human limb, said pocket means includes a pocket having at least three open ends.

2. A flashlight holster according to claim 1, wherein:

said at least two mutually orthogonal orientations include an orientation substantially parallel to said strap.

3. A flashlight holster according to claim 1, wherein:

said strap further includes reflective means for reflecting light.

4. A flashlight holster according to claim 1, wherein:

said strap is elastic and said pocket means is elastic.

5. A flashlight holster, comprising:

a) a strap having a first end, a second end, a first side, and a second side;

b) a D-ring attached to said first end of said strap;

c) one of a hook and loop fastener on both first and second sides of said strap adjacent said second end of said strap;

d) the other of a hook and loop fastener on said first side of said strap adjacent said first end of said strap; and e) pocket means attached to said strap for receiving and holding a flashlight, wherein said pocket means is adapted to receive and hold a flashlight in at least two mutually orthogonal orientations.

6. A flashlight holster according to claim 5, wherein:

said at least two mutually orthogonal orientations include an orientation which is parallel to said strap.

7. A flashlight holster according to claim 5, wherein:

said pocket means includes a pocket having four open ends.

8. A flashlight holster according to claim 5, further comprising:

f) reflective means for reflecting light, said reflective means attached to said pocket means.

9. A flashlight holster according to claim 5, wherein:

said strap is elastic and said pocket means is elastic.

10. A flashlight holster, comprising:

a) a strap having a first end, a second end, a first side, and a second side;

b) a D-ring attached to said first end of said strap;

c) one of a hook and loop fastener on both first and second sides of said strap adjacent said second end of said strap;

d) the other of a hook and loop fastener on said first side of said strap adjacent said first end of said strap; and e) pocket means attached to said strap for receiving and holding a flashlight, wherein said pocket means includes a pocket having at least three open ends.

* * * * *